US006463237B2

(12) United States Patent
Suda et al.

(10) Patent No.: US 6,463,237 B2
(45) Date of Patent: Oct. 8, 2002

(54) IMAGE FORMING APPARATUS AND CHARGE ROLLER THEREFOR

(75) Inventors: Takeo Suda, Tokyo; Akiyoshi Tanaka, Kanagawa, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/757,616

(22) Filed: Jan. 11, 2001

(65) Prior Publication Data

US 2001/0014232 A1 Aug. 16, 2001

(30) Foreign Application Priority Data

Jan. 13, 2000 (JP) ..... 2000-004263

(51) Int. Cl.[7] ..... G03G 15/02
(52) U.S. Cl. ..... 399/176
(58) Field of Search ..... 399/50, 168, 174, 399/175, 176

(56) References Cited

U.S. PATENT DOCUMENTS 5,235,386 A * 8/1993 Yano et al. ..... 399/176
5,532,795 A 7/1996 Tatsumi et al.
5,581,329 A * 12/1996 Kosmider et al. ..... 399/176
5,733,235 A * 3/1998 Waku et al. ..... 399/176 X
5,761,581 A * 6/1998 Nojima ..... 399/174
5,786,091 A * 7/1998 Kurokawa et al. ..... 399/176 X
5,991,557 A * 11/1999 Kunishi et al. ..... 399/50
6,001,454 A * 12/1999 Murata et al. ..... 399/176
6,072,970 A * 6/2000 Barton et al. ..... 399/176
6,190,295 B1 * 2/2001 Kawano et al. ..... 399/176 X

FOREIGN PATENT DOCUMENTS

JP 9-43936 2/1997
JP 11-194533 7/1999

* cited by examiner

*Primary Examiner*—Sandra Brase
(74) *Attorney, Agent, or Firm*—Oblon, Spivak, McClelland, Maier & Neustadt, P.C.

(57) ABSTRACT

An image forming apparatus includes a charge roller rotatable in contact with the surface of an image carrier to thereby charge the surface. The charged surface of the image carrier is exposed imagewise for forming a latent image. A developing device develops the latent image to thereby form a corresponding toner image. The toner image is transferred to a recording sheet. The charge roller is formed of a core and an elastic body affixed to the periphery of the core. Stearic acid to be added to rubber, which is the major component of the elastic body, is selected to be 1 wt % or less. An AC current value to be applied to the core is selected to be 1.1 mA or less. The image carrier is free from defective charging ascribable to impurities to deposit on the charge roller.

6 Claims, 4 Drawing Sheets

*Fig. 3*

| STEARIC ACID CONTENT / AC CURRENT | 0.5 wt % | 1.0 wt % | 2.0 wt % |
|---|---|---|---|
| 0.9 mA | 20,000 OK | 20,000 OK | 20,000 OK |
| 1.0 mA | 20,000 OK | 20,000 OK | 10,000 DEFECTIVE CHARGING |
| 1.1 mA | 20,000 OK | 20,000 OK | 12,000 DEFECTIVE CHARGING |
| 1.2 mA | 20,000 OK | 10,000 DEFECTIVE CHARGING | 7,000 DEFECTIVE CHARGING |

IMAGE FORMING APPARATUS AND CHARGE ROLLER THEREFOR

BACKGROUND OF THE INVENTION

The present invention relates to an image forming apparatus and more particularly to a charge roller included in an image forming apparatus and rotatable in contact with the surface of an image carrier, which is driven such that the surface moves, for thereby charging the surface of the image carrier. The charge roller is made up of a core and an elastic body affixed to the periphery of the core and formed mainly of rubber.

Generally, an electrophotographic copier, printer, facsimile apparatus, multiplex machine or similar image forming apparatus includes a charge roller made up of a core and an elastic body affixed to the core for uniformly charging the surface of an image carrier. An AC-biased DC voltage is applied to the charge roller.

Stearic acid, which is a specific treatment aid, is usually added to rubber that constitutes the elastic body of the charge roller. During the fabrication of the charge roller, stearic acid prevents rubber from sticking to, e.g., a pair of rollers used to knead rubber. However, the problem with stearic acid is that it is separated on the surface of the charge roller due to the influence of humidity and temperature. As the charge roller is repeatedly used over a long period of time, separated stearic acid is apt to aggravate the contamination of the charge roller and thereby make the charging of the image carrier and therefore images defective.

A cleaner formed of foam urethane or felt, for example, may be held in contact with the charge roller in order to clean the surface of the charge roller. The cleaner, however, must be angularly moved by a moving device in its lengthwise direction so as to obviate irregular cleaning, increasing the cost of the image forming apparatus.

Technologies relating to the present invention are disclosed in, e.g., Japanese Patent Laid-Open Publication Nos. 9-43936 and 11-194533.

SUMMARY OF THE INVENTION

It is therefore an object of the present invention to provide an image forming apparatus capable of effectively reducing the defective charging of an image carrier ascribable to stearic acid separated on the surface of a charge roller, and a charge roller therefor.

In accordance with the present invention, an image forming apparatus includes an image carrier to be driven such that its surface moves. A charge roller is made up of a core and an elastic body affixed to the periphery of said core. The charge roller charges the surface of the image carrier by being applied with an AC-biased DC voltage while rotating in contact with the surface. The major component of the elastic body is rubber. An exposing device exposes the surface of the image carrier charged by the charge roller imagewise to thereby form a latent image thereon. A developing device develops the latent image with toner to thereby form a corresponding toner image. A fixing device fixes the toner image transferred to a recording sheet. Stearic acid is added to rubber constituting the elastic body in an amount of 1 wt % or less.

Also, in accordance with the present invention, a charge roller for charging the surface of an image carrier while rotating in contact with the surface is made up of a core and an elastic body affixed to the periphery of the core and formed mainly of rubber. Stearic acid is added to rubber constituting the elastic body in an amount of 1 wt % or less.

BRIEF DESCRIPTION OF THE DRAWINGS

The above and other objects, features and advantages of the present invention will become more apparent from the following detailed description taken with the accompanying drawings in which:

FIG. 3 is a table listing the results of experiments; and

DESCRIPTION OF THE PREFERRED EMBODIMENT

Figure 1:
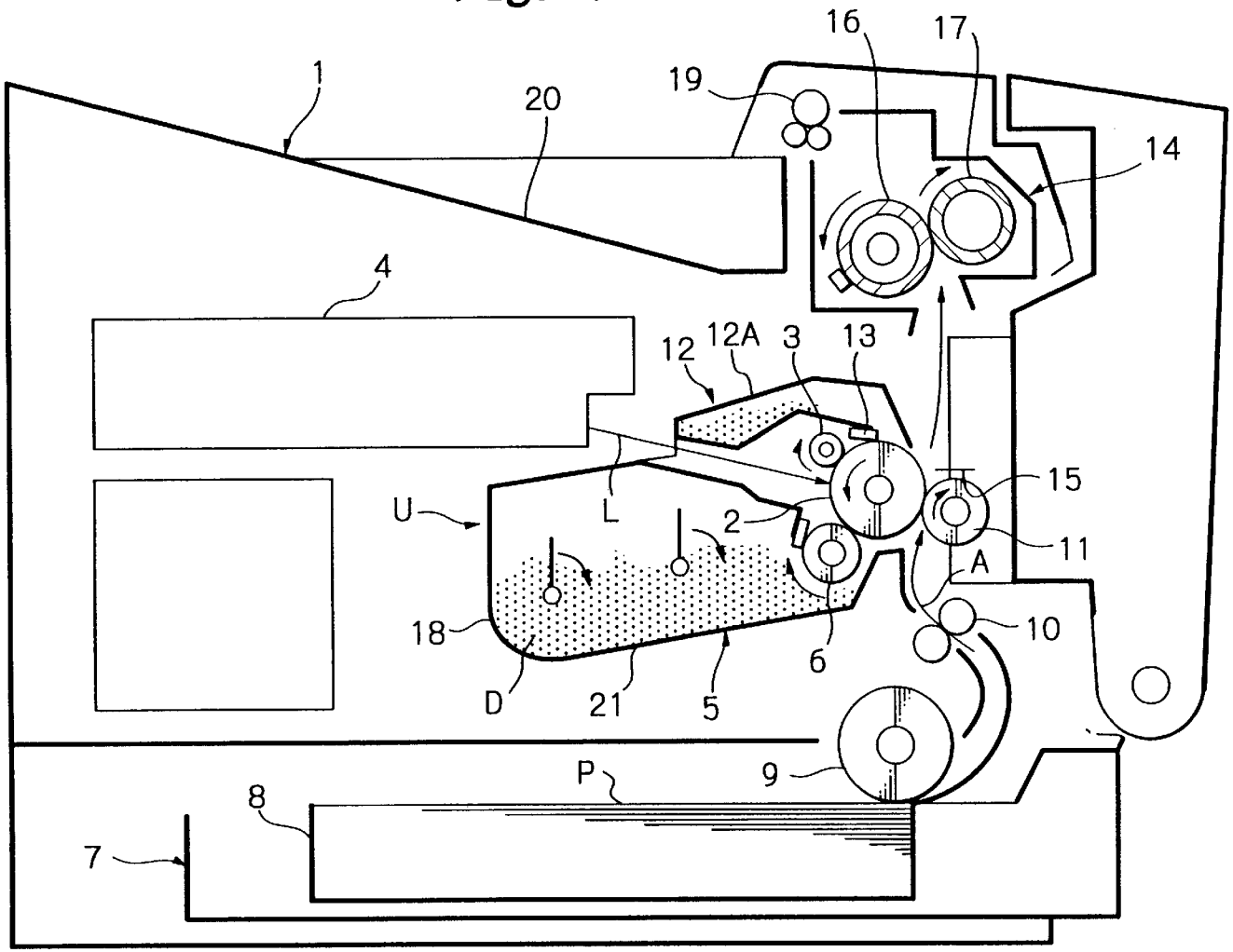
FIG. 1 is a vertical section showing an image forming apparatus embodying the present invention.
Figure 2:
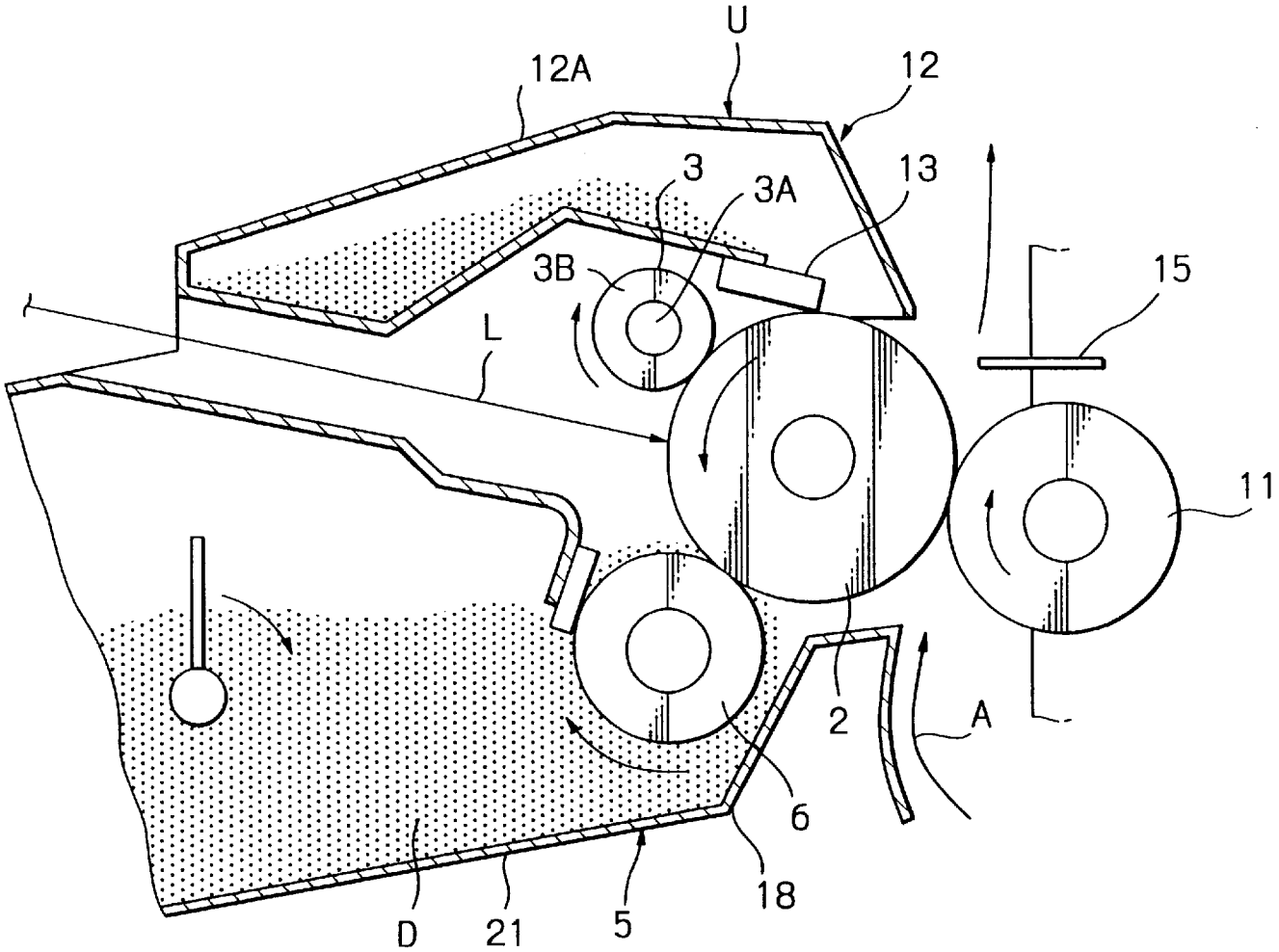
FIG. 2 is an enlarged fragmentary view of the illustrative embodiment.

Referring to FIGS. 1 and 2 of the drawings, an image forming apparatus embodying the present invention is shown and implemented as a printer by way of example. As shown, the printer has a body 1 accommodating a photoconductive drum 2, which is a specific form of an image carrier. The drum 2 is rotated counterclockwise, as viewed in FIGS. 1 and 2, during image formation. The drum 2 may be replaced with an endless belt passed over a plurality of rollers, if desired. In any case, the image carrier is driven such that its surface moves.

A charge roller or charger 3 is held in contact with the surface of the drum 2 and rotated clockwise, as viewed in FIGS. 1 and 2, by the drum 2. The charge roller 3 is made up of a conductive, rigid core 3A and an annular elastic body 3B coaxial with the core 3A and affixed to the outer periphery of the core 3A. The major component of the elastic body 3B is NBR (acrylonitrile-butadiene rubber), epichlorohydrin rubber or similar rubber. Carbon black or an ion conductor is added to the above major component as a conductive agent. Further, stearic acid is added to the major component as a treatment aid. The outer periphery of the elastic body 3B may be coated with resin. The surface of the elastic body 3B contacts the surface of the drum 2 either directly or via the resin coating. In the illustrative embodiment, the core 3A of the charge roller 3 is implemented as a metal rod.

A power source, not shown, applies an AC-biased DC voltage to the core 3A of the charge roller 3. The charge roller 3, rotating in contact with the surface of the drum 2, uniformly charges the surface of the drum 2 to a preselected polarity, e.g., a potential of −600 V.

A laser writing device 4, which is a specific form of an exposing device, is disposed in the casing 1 and emits a laser beam L in accordance with image data. The laser beam L scans the charged surface of the drum 2 to thereby electrostatically form a latent image. In the illustrative embodiment, the potential on the surface of the drum 2 decreases in absolute value in the area of the drum 2 scanned by the laser beam L, forming the latent image. The other area of the drum 2 constitutes the background of the latent image.

A developing device 5 develops the latent image to thereby form a corresponding toner image. The developing device 5 includes a casing 18 storing a powdery developer D. A developing roller 6 conveys the developer D deposited thereon. The toner is electrostatically transferred from the developing roller 6 to the latent image formed on the drum 2, developing the latent image. While the developer D may be either one of a toner and carrier mixture and toner, the illustrative embodiment uses toner, i.e., a one ingredient type developer.

A sheet feeder 7 is positioned in the lower portion of the casing 1 and includes a cassette 8 loaded with a stack of recording sheets P. A pick-up roller 9 rotates to feed the recording sheets P from the cassette 8 toward a registration roller pair 10 one by one. The registration roller pair 10 conveys the recording sheet P toward an image transfer station between a transfer roller 1 and the drum 2 at such a timing that the leading edge of the sheet P meets the leading edge of the toner image. The transfer roller 1 is a specific form of an image transferring device. At the image transfer station, the toner image is transferred from the drum 2 to the sheet P. Specifically, a voltage opposite in polarity to the charge of the toner deposited on the drum 2 is applied to the transfer roller 11. The transfer roller 11 in rotation electrostatically transfers the toner image from the drum 2 to the recording sheet P. The recording sheet P may be a paper sheet, a sheet or a film of resin or a piece of cloth by way of example.

A cleaning device 12 includes a cleaning blade 13. The cleaning blade removes the toner left on the drum 2 after the transfer of the toner image to the recording sheet P and thereby prepares the drum 2 for the next image formation. The toner removed by the cleaning blade 13 is collected in a casing 12A.

A separator implemented by needles 15 separates the recording sheet or printing P from the drum 2. The recording sheet P is then conveyed upward to a fixing device 14, which includes a heat roller 16 and a press roller 17. The heat roller 16 and press roller 17 fix the toner image on the recording sheet P with heat and pressure. An outlet roller pair 19 conveys the recording sheet P with the fixed toner image to a tray 20 with the image surface of the sheet P facing downward. The tray 20 is implemented by an outside cover mounted on the body 1.

As stated above, the illustrative embodiment includes the drum or image carrier 2 driven such that its surface moves. The charge roller 3 charges the surface of the drum 2 while rotating in contact therewith. The exposing device 4 exposes the charged surface of the drum 2 imagewise so as to form a latent image thereon. The developing device 5 develops the latent image with toner to thereby form a corresponding toner image. The fixing device 14 fixes the toner image transferred from the drum 2 to the recording sheet P. The charge roller 3 is made up of the core 3A and elastic body 3B affixed to the core 3A. The major component of the elastic body 3B is rubber. An AC-biased DC voltage is applied to the charge roller 3.

While the illustrative embodiment directly transfers the toner image from the drum 2 to the recording sheet P, an intermediate transfer body may intervene between the drum 2 and the sheet P. In such a case, the toner image will be transferred from the drum 2 to the intermediate transfer body and then to sheet P.

In the illustrative embodiment, the drum 2 and charge roller 3 are rotatably supported by a cartridge casing 21. The cartridge casing 21 constitutes the casing 18 of the developing device 5 and the casing 12A of the cleaning device 12. Such structural elements are constructed into a single process cartridge U. Only the drum 2, charge roller 3 and cartridge casing 21 may constitute the process cartridge U, if desired. The crux is that the charge roller 3 is implemented as a process cartridge U, which is constructed integrally with the cartridge casing 21, together with at least the image carrier 2. The process cartridge U is removably mounted to the body 1. The process cartridge U is replaced with a new process cartridge when its service life ends, e.g., when the developing device 5 runs out of toner or when the casing 12A is filled with collected toner.

Stearic acid is added to rubber, which constitutes the elastic body 3B of the charge roller 3, as a treatment aid, as stated earlier. Stearic acid is, however, separated on the surface of the charge roller 3 and is apt to degrade the function of the roller 3. That is, the charge roller 3 is apt to fail to charge the drum 2 in the expected manner, resulting in defective images, as discussed previously.

In light of the above, in the illustrative embodiment, the amount of stearic acid to be added to the elastic body 3B is selected to be 1 wt % or less. This is successful to effectively protect the drum 2 from defective charging and insure desirable image quality, as proved by experiments. FIG. 3 shows the results of experiments conducted with the charge roller 3 left unused over a long period of time until stearic acid was separated. In FIG. 3, "OK" shows that the drum 2 was free from defective charging while "AC Current" shows the effective value of the AC component of the current fed to the core 3A.

As FIG. 3 indicates, the number of prints that can be produced without the defective charging of the drum 2 decreases with an increase in the amount of stearic acid and with an increase in the AC component.

The defective charging of the drum 2 is ascribable to an increase in the resistance of the charge roller 3 caused by impurities that are deposited on the charge roller 3. The impurities include fine toner particles and paper dust that the cleaning blade 13 failed to remove. It was experimentally found that more stearic acid was separated a on the surface of the charge roller 3 as its amount increased, so that the amount of impurities to deposit on the roller 3 was related to the amount of stearic acid to be separated. It was also found that the deposition of impurities was aggravated as the AC current increased. Further, it will be seen that by limiting the amount of stearic acid to 1.0 wt % or less, the defective charging of the drum 2 does not occur even when 15,000 prints are produced. More preferably, the amount of stearic acid should be 0.5 wt % or less although such an amount makes treatment somewhat difficult.

Moreover, as FIG. 3 indicates, if the amount of stearic acid is 1.0 wt % or less and if the effective value of the AC component to be applied to the charge roller 3 is 1.1 mA or less, the defective charging of the drum 2 does not occur even when more than 20,000 prints are produced.

Figure 4:
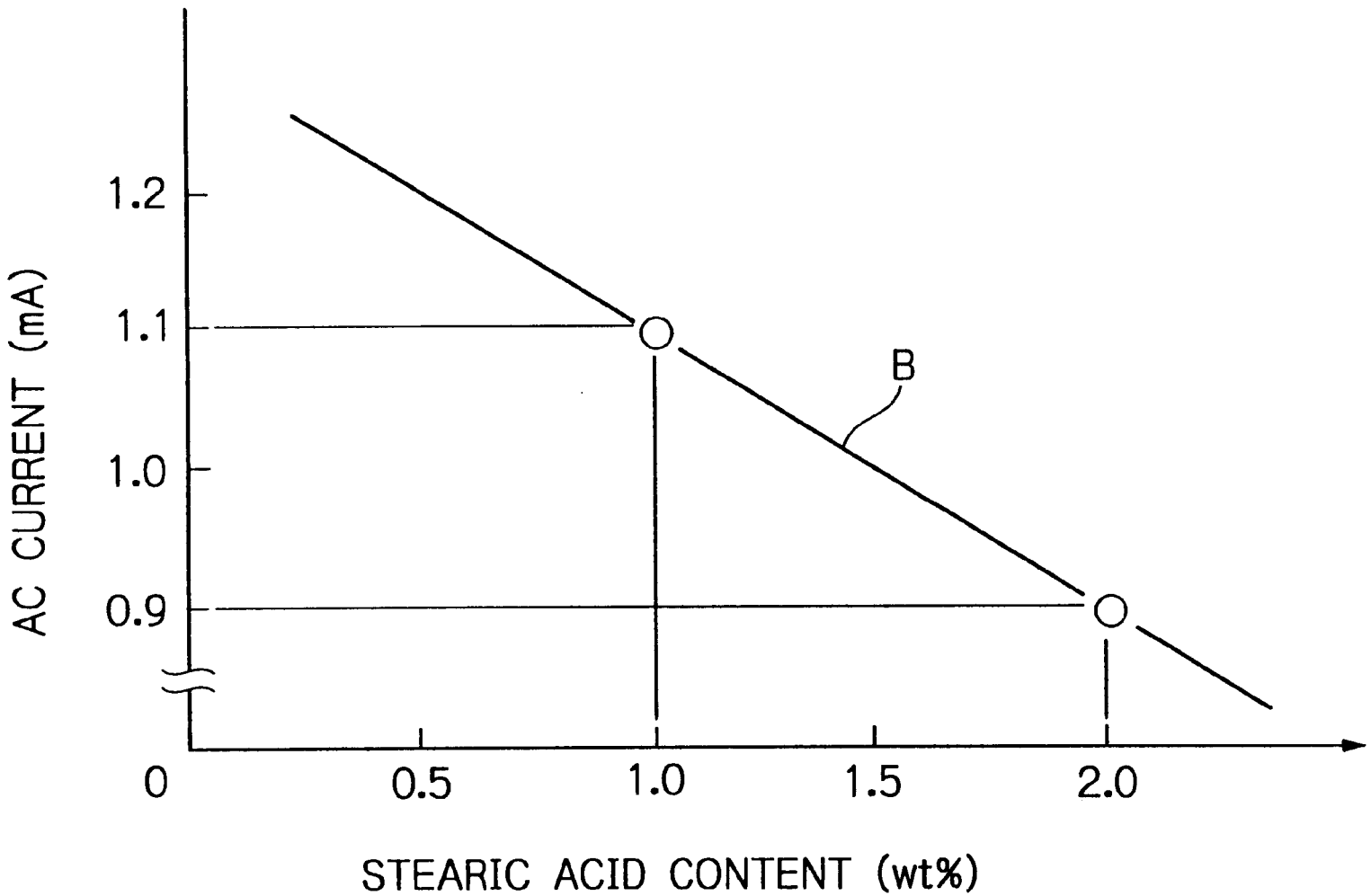
FIG. 4 is a graph corresponding to the table of FIG. 3.

FIG. 4 graphs the results of experiments shown in FIG. 3. In FIG. 4, the abscissa and ordinate respectively indicate the amount of stearic acid added (wt %) and the effective value of the AC component applied to the core 3A. Assume that the amount of stearic acid added the elastic body or rubber 3B is x (wt %), and that the effective value of the AC component applied to the core 3A is y (mA) Then, a line B shown in FIG. 4 satisfies a relation:

$$y=-0.2x+1.3$$

If a relation of $y \leqq 0.2x+1.3$ holds, the defective charging of the drum 2 does not occur even when 20,000 prints are produced. It is therefore preferable to select the amount of stearic acid and AC component such that they satisfy the relation of $y \leqq 0.2x+1.3$.

As stated above, if the amount of stearic acid is 1 wt % or less and if the effective value of the AC component is 1.1 mA or less, the defective charging of the drum 2 does not occur up to 20,000 prints, as proved by FIG. 4 also. This protects image quality from deterioration and insures high-quality images at all times.

In the illustrative embodiment, the charge roller 3 and drum 2 are implemented as a process cartridge U, which is constructed integrally with the cartridge casing 21, as stated earlier. Usually, the service life of the process cartridge U is relatively short, i.e., it ends when 10,000 to 20,000 prints are produced. Therefore, when the charge roller 3 is applied to the process cartridge U, the defective charging of the drum 2 does not occur until the life of the process cartridge U ends, insuring high-quality images at all times. This can be done without resorting to exclusive impurity removing means, which is made up of a cleaner for removing impurities from the charge roller 3 and a device for angularly moving the cleaner.

The effective value of the AC component to be applied to the charge roller 3 should preferably be 1.1 mA or below, but above 0.8 mA, particularly 0.9 mA or above. Experiments showed that the effective value of 0.8 mA or below made the charging of the drum 2 irregular and thereby lowered image quality.

It is to be noted that the present invention is applicable to a broad range of image forming apparatuses including various types of printers, copiers and facsimile apparatuses as well as combinations thereof.

In summary, it will be seen that the present invention provides an image forming apparatus and a charge roller therefore having various unprecedented advantages, as enumerated below.

(1) The amount of stearic acid to be added to rubber, which constitutes the elastic body of the charge roller, is selected to be 1 wt % or less. Stearic acid is therefore separated on the surface of the charge roller little, so that the deposition of impurities on the charge roller is reduced. It follows that the charge roller is capable of desirably charging an image carrier over a long period of time, insuring high-quality images.

(2) An AC component to be applied to the charge roller is selected to be 1.1 mA or less. This more effectively reduces the deposition of impurities on the charge roller.

(3) The charge roller is included in a process cartridge whose service life is relatively short. Therefore, the defective charging of the image carrier is obviated till the end of the life of the process cartridge without resorting to exclusive impurity removing means for the charge roller. This not only insures high image quality at all times, but also reduces the cost of the process cartridge and therefore the entire image forming apparatus.

(4) The charge roller allows a minimum of impurities to deposit thereon.

Various modifications will become possible for those skilled in the art after receiving the teachings of the present disclosure without departing from the scope thereof.

What is claimed is:

1. An image forming apparatus comprising:

an image carrier configured to be driven such that a surface thereof moves;

a charge roller comprising a core and an elastic body affixed to a periphery of said core, and configured to charge a surface of said image carrier by being applied with an AC-biased DC voltage while rotating in contact with said surface, wherein a major component of said elastic body is rubber;

an exposing device constructed to expose the surface of said image carrier charged by said charge roller imagewise to thereby form a latent image on said surface;

a developing device constructed to develop the latent image with toner to thereby form a corresponding toner image; and a fixing device constructed to fix the toner image transferred to a recording sheet; and wherein:

stearic acid is added to rubber constituting said elastic body in an amount of 1 wt % or less, and an AC component of a current charge is fed to said charge roller with an effective value of 1.1 mA or less.

2. An apparatus as claimed in claim 1, wherein said charge roller is constructed into a process cartridge, which is constructed integrally with a cartridge casing and removably mounted to a body of said apparatus, together with at least said image carrier.

3. An apparatus as claimed in claim 1, wherein said charge roller is constructed in a process cartridge, which is constructed integrally with a cartridge casing and removably mounted to a body of said apparatus, together with at least said image carrier.

4. An image forming apparatus comprising:

an image carrier to be driven such that a surface thereof moves;

a charge roller comprising a core and an elastic body affixed to a periphery of said core for charging a surface of said image carrier by being applied with an AC-biased DC voltage while rotating in contact with said surface, wherein a major component of said elastic body is rubber;

exposing means for exposing the surface of said image carrier charged by said charge roller imagewise to thereby form a latent image on said surface;

developing means for developing the latent image with toner to thereby form a corresponding toner image; and fixing means for fixing the toner image transferred to a recording sheet; and wherein:

stearic acid is added to the rubber constituting said elastic body in an amount of 1 wt % or less, and an AC component of a current is fed to said charge roller with an effective value of 1.1 mA or less.

5. An apparatus as claimed in claim 4, wherein said charge roller is constructed into a process cartridge, which is constructed integrally with a cartridge casing and removably mounted to a body of said apparatus, together with at least said image carrier.

6. An apparatus as claimed in claim 4, wherein said charge roller is constructed in a process cartridge, which is constructed integrally with a cartridge casing and removably mounted to a body of said apparatus, together with at least said image carrier.

* * * * *